United States Patent [19]

Ishida et al.

[11] 4,007,045

[45] Feb. 8, 1977

[54] ELECTROPHOTOGRAPHIC COLOR PROCESS AND ELECTROPHOTOGRAPHIC LIGHT-SENSITIVE MATERIAL FOR USE IN THE ELECTROPHOTOGRAPHIC COLOR PROCESS

[75] Inventors: Eisuke Ishida, Nara; Yuji Takashima, Osaka; Hisanori Nishiguchi, Neyagawa; Fujio Oda, Ashiya, all of Japan

[73] Assignee: Matsushita Electric Industrial Co., Ltd., Japan

[22] Filed: Mar. 14, 1975

[21] Appl. No.: 558,560

[30] Foreign Application Priority Data

Mar. 27, 1974 Japan ..... 49-34990
Apr. 9, 1974 Japan ..... 49-40536

[52] U.S. Cl. ..... 96/1.5; 96/1.2
[51] Int. Cl.[2] ..... G03G 5/12; G03G 5/04
[58] Field of Search ..... 96/1.2, 1.5, 90 R

[56] References Cited

UNITED STATES PATENTS

| | | | |
|---|---|---|---|
| 3,212,887 | 10/1965 | Miller et al. | 96/1.2 |
| 3,253,913 | 5/1966 | Smith et al. | 96/1.2 |
| 3,847,607 | 11/1974 | Erido et al. | 96/90 R |
| 3,873,309 | 3/1975 | Goffe | 96/1.2 |

OTHER PUBLICATIONS

Chemical Abstracts, vol. 80, Col. 1511984, vol. 83, Col. 186337g, vol. 81, Col. 71117b.

*Primary Examiner*—John D. Welsh
*Attorney, Agent, or Firm*—Burgess Ryan and Wayne

[57] ABSTRACT

The present invention relates to an electrophotographic color process comprising the steps of: (a) charging an electrophotographic light-sensitive material by corona discharge, said material having at least two kinds of color-producing photoconductive particles disposed at random on an electroconductive support, said color-producing photoconductive particles consisting essentially of a photoconductive particle, a sensitizer and a leuco dye, (b) exposing said charged material to light, (c) developing said material by toner containing acid substance, and producing color in the leuco dye by the interaction of the leuco dye with the acid substance, and forming a color image by carrying out once the procedure of charging, exposing and developing.

An electrophotographic light-sensitive material comprising an electroconductive support and a photoconductive layer consisting of at least two kinds of color-producing photoconductive particles disposed at random on the support, said color-producing photoconductive particles consisting essentially of a photoconductive particle, a sensitizer and a leuco dye.

14 Claims, 2 Drawing Figures

ELECTROPHOTOGRAPHIC COLOR PROCESS AND ELECTROPHOTOGRAPHIC LIGHT-SENSITIVE MATERIAL FOR USE IN THE ELECTROPHOTOGRAPHIC COLOR PROCESS

BACKGROUND OF THE INVENTION

Electrophotographic light-sensitive material comprises an electroconductive support with a photoconductive layer formed thereon. The principle of an electrophotographic process in the black and white reproduction field is that an electrostatic latent image is produced by image-wise exposure of a charged photoconductive layer and the image is then developed by particulate matter, called a toner, which is electrically deposited on the latent image to form a visible image.

Applications of such an electrophotographic process for color reproduction have been proposed and one of the color process has been disclosed on pages 97–98 in "Electrophotography" edited by R. M. Schaffert. As shown in this literature, the process for color reproduction comprises the repetition of the same procedure three times using three different toners, said procedure consisting of charging the electrophotographic light-sensitive material by corona discharge, exposing the material to light (red, green and blue), developing the material with different toners (developers) and transferring the developed image to white paper.

It is an object of the present invention to provide an electrophotographic color process in which a color image can be obtained by carrying out once the procedure of sensitizing, exposing and developing.

It is another object of the present invention to provide an electrophotographic light-sensitive material for use in the electrophotographic color process.

SUMMARY OF THE INVENTION

The present invention relates to an electrophotographic color process and an electrophotographic light-sensitive material for use in the process thereof.

The electrophotographic light-sensitive material of this invention is made by disposing at least two kinds of color-producing photoconductive particles at random on an electroconductive support, said particles consisting essentially of a photoconductive particle, a sensitizer and a leuco dye.

The electrophotographic color process comprises charging said electrophotographic light-sensitive material by corona discharge, exposing said charged material to color light, developing said material by a toner containing acid substance, and producing color in the leuco dye by the interaction of the leuco dye with the acid substance by heating or using a solvent. Thus, a color image can be formed on the support of the light-sensitive material.

In the process of this invention, at least two kinds of color-producing photoconductive particles are used. However, the principle of the electrophotographic color process of this invention will be illustrated by using three kinds of color-producing photoconductive particles.

Color-producing photoconductive particles B, G and R consist of the following: Particle B consists of a photoconductive particle, a sensitizer absorbing blue-violet light and a leuco dye producing yellow color. Particle G consists of a photoconductive particle, a sensitizer absorbing green light and a leuco dye producing magenta color. Particle R consists of a photoconductive particle, a sensitizer absorbing red light and a leuco dye producing cyan color.

When Color-producing photoconductive particles B, G and R are charged by corona discharge and exposed to light, Particles B, G and R, respectively, absorb blue-violet, green and red light to leak away the electric charge.

Referring to the accompanying drawings, FIG. 1, shows an electrophotographic light-sensitive material comprising an electroconductive support and a photoconductive layer formed on the support, the photoconductive layer consisting of Color-producing photoconductive particles B, G and R disposed at random on the support. When the photoconductive layer is positively charged by corona discharge and then exposed to blue-violet, green and red light, electrical charges of Particles B, G and R leaks away or remain as follows and electrostatic latent images are formed on the photoconductive layer: In the region (B) irradiated by blue-violet light, electrical charge of Particle B leaks away and electrical charges of Particles G and R remain. In the region (G) irradiated by green light, electrical charge of Particle G leaks away and electrical charges of Particle B and R remain. In the region (R) irradiated by red light, electrical charge of Particle R leaks away and electrical charges of Particles B and G remain.

Accordingly, visible color images can be formed by developing the photoconductive layer having the latent image with negatively charged toner to obtain a positive-to-positive color print as follows: In the region irradiated by blue-violet light, negatively charged toners are deposited on Particles G and R, and leuco dyes of Particles G and R react with acid substance of the toner to produce a magenta and cyan color. Blue-violet color can be obtained from the magenta and cyan color. On the basis of the principle as stated above, in the region irradiated by green light, the toners are deposited on Particles B and R to produce a yellow and cyan color. Green color can be obtained from the yellow and cyan color. Similarly, in the region irradiated by red light, the toners are deposited on Particles B and G to produce a yellow and magenta color. Red color can be obtained from the yellow and magenta color.

Thus, a positive-to-positive color print can be obtained.

In the process as stated above, when positively charged toners are used instead of negatively charged toners, positively charged toners are deposited on Particles B, G and G in which electrical charges have been dissipated. Accordingly, a positive-to-negative color print, namely, a color print having a complementary color of the original color can be obtained.

Referring to the accompanying drawings FIG. 2, white, black, yellow, magenta and cyan colors can be obtained on the basis of the same principle as stated above.

An electrophotographic light-sensitive material of this invention may be prepared as follows:

A dispersion is obtained by mixing a photoconductive particle (powder of photoconductor), a sensitizer and a leuco dye in a solution which has been prepared by dissolving a binder in a polar solvent. A residue is obtained by evaporating the solvent of the dispersion. The resulting residue is pulverized to obtain a fine powder of the color-producing photoconductive particle having a particle size of 10 to 100 microns.

The fine powder is distributed over a surface of an electroconductive support having an adhesive layer.

Such a support may be prepared by coating a solution on a surface of the support by means of a wire bar, said solution having been prepared by dissolving a binder in a non-polar solvent. The support having distributed powder is dried to evaporate the solvent and then passed through a calender at a temperature of 20° to 150° C. The color-producing photoconductive particles adhere to one another and to the support during the heating.

Alternatively, the fine powder is electrostatically deposited on a surface of charged dielectric substrate and then the fine powder, i.e., the color-producing photoconductive particle, is transferred from the dielectric substrate onto an electroconductive support, for example, by pressing or pressing under condition of heating or by electrical attraction.

The fine powder of the color-producing photoconductive particle may be prepared by spraying the dispersion obtained above with air or nitrogen gas having a pressure of 1 to 5 kg/cm$^2$ into an atmosphere having a temperature of 10° to 30° C to dry a fine drop of the dispersion.

A toner used in this invention comprises a binder and one of the acid substance selected from the group consisting of a phenolic substance, an organic acid and an acid inorganic substance.

The electrophotographic color process using the light-sensitive material of this invention involves the following steps:

1. Charging the light-sensitive material by electrical charging (e.g., corona discharge).
2. Exposing the material to form an electrical latent image.
3. Developing the latent image with toners.
4. Producing color by the interaction of a leuco dye with an acid substance.

The interaction of the leuco dye with the acid substance may be accomplished by heating or by dissolving the leuco dye or the acid substance with a solvent.

In this invention, the following photoconductors may be used: Polyvinylcarbazole, polyvinylanthracene, selenium, zinc oxide, titanium oxide and others.

The sensitizers added to the photoconductors are as follows: Blue sensitizer (sensitizer absorbing blue-violet light): Uranine, Fluorecein, Tartrazine, 3-carboxymethyl-5-(3-ethyl-2(3)-benzthiazolidene)-rhodamine-triethylamine salt, Auramine and Seto-flavin T. Green sensitizer (sensitizer absorbing green light): Rose Bengale, Eosine, Erythrosine, Fuchsine, Pyronine B, Rhodamine G, Violanin, Methyl Violet, Neutral Red and Astrophloxine. Red sensitizer (sensitizer absorbing red light): Diacid Cyanine Green GWA, Methylene Blue, Patent Blue V, Victoria Blue B, Xylene Cyanol FF and Bantamil Brilliant Blue A.

Such sensitizers are used in an amount of 0.001 to 2% by weight, preferably 0.002% to 0.2% by weight, based on the amount of photoconductor.

As a binder of the photoconductive particle, the following thermoplastic polymers may be used alone or in a mixture thereof: Rosin, ester gum, silicone resin, alkyd resin, polyester resin, acrylic resin, styrene-butadiene resin, vinyl resin and petroleum resin. The binder is used in an amount of 5 to 40% by weight based on the amount of photoconductive particle.

As an electroconductive support, an art paper, high quality paper applied high molecular quaternary ammonium salt (for example, ECR-34 made by Dow Chemical Co.), electroconductive plastic film, metal sheet and others may be used.

As an adhesive of the photoconductive particle to an electroconductive support, the following rubbers or resins may be used alone or in a mixture thereof: Butyl rubber, terpene resin, ester gum, petroleum resin, polyurethane, modified acrylic resin and rubbers (which are soluble in a non-polar solvent). As dielectrics (dielectric substrate) used to attract electrostatically the photoconductive particle and transfer it to the electroconductive support, the following plastic films may be used: Plastic film such as polyester, polyvinyl fluoride, silicone rubber, nitrocellulose, polyacrylic ester, polyvinyl chloride and epoxy resin. Furthermore, paper having the above-cited high polymer laminated or paper having wax impregnated or coated may be used as the dielectric substrate.

Leuco dyes used in this invention are basic dyes having a chromophore in the molecule. Typical leuco dyes are as follows: Compounds having a lactone ring such as 3,3-bis(p-dimethylaminophenyl)-6-dimethylaminophthalide[Crystal Violet Lactone], 3,3-bis(p-dimethylaminophenyl)phthalide[Marachite Green Lactone], 3-diethylamino-7-dibenzylaminofluoran, 3-dimethylamino-6-methoxyfluoran, 3,3'-bis(-paradimethylaminophenyl)-6-(paratoluenesulfonamide)phthalide, 3-diethylamino-7-(N-methylaniline)fluoran, 3-diethylamino-7-(N-methyl-p-toluidine)fluoran, 3-diethylamino-6-methyl-7-chlorofluoran and 3-morpholino-5,6-benzofluoran; compounds having lactam ring such as 3,6-di-p-toluidino-4,5-dimethylfluoran-phenylhydrazine-$\gamma$-lactam, Rhodamine B lactam, N-(p-nitrophenyl)Rhodamine B lactam and 3,6-di- B-naphthylamino-5-methylfluoran-6-lactam; polyarylcarbinols such as bis(p-dimethylaminophenyl)methanol [Michler's hydrol] and Crystal Violet Carbinol; spirophthalan such as 6,6'-diaminospiro(phthalan-1,9'-xanthene) and 6,6'-diethylaminospiro(phthalan-1,9'-xanthene); phthalans such as 1,1'-bis(p-aminophenyl)phthalan and 1,1'-bis(p-benzylaminophenyl)phthalan; a diphenylmethane dye such as Auramine which does not contain hydrochloric acid.

The leuco dyes are used in an amount of 0.02 to 50% by weight based on the amount of photoconductor.

The acid substances used for preparing the toner are as follows: Phenolic substances such as 4-tert-butylphenol, 4-hydroxydiphenoxide, $\alpha$-naphthol, $\beta$-naphthol, 2,2'-dihydroxydiphenyl, 4methylumbelliferone, 4,4'-isopropylidenediphenyl [Bisphenol A], Naphthol AS-D, Naphthol AS-OL and 2,3,4,6-tetrachlorophenol; organic acids such as oxalic acid, salicylic acid, 2-hydroxy-3-naphthoic acid and 2-naphthol-6,8-disulfonic acid-2-potassium; acid inorganic substances such as powdered silicate and Japanese acid clay.

As a binder for preparing the toner, the following resins may be used: Polystyrene, phenolic resins and petroleum resins (made from unsaturated hydrocarbons).

Such binders are used in an amount of 5 to 50% by weight, based on the amount of the acid substance.

The following solvents may be used for dissolving the leuco dye or the acid substance: Alcohols such as methanol and ethanol; ketones such as acetone and methyl ethyl ketone; aromatic hydrocarbons such as benzene and toluene; halogenated hydrocarbons such as ethylene chloride and trichloroethylene; and tetrahydrofuran.

In the above, electrophotographic light-sensitive materials producing full color have been illustrated. However, the photoconductive layer of the electrophotographic light-sensitive material may contain at least two kinds of color-producing photoconductive particles as provided by mixing Color-producing photoconductive particles A and B as follows: Particle A comprises a photoconductive particle, a sensitizer and a leuco dye. Particle B comprises a photoconductive particle, a sensitizer and a leuco dye, said sensitizer and leuco dye being different from the sensitizer and leuco dye used in Particle A.

DESCRIPTION OF THE PREFERRED EMBODIMENTS

Figure 1:
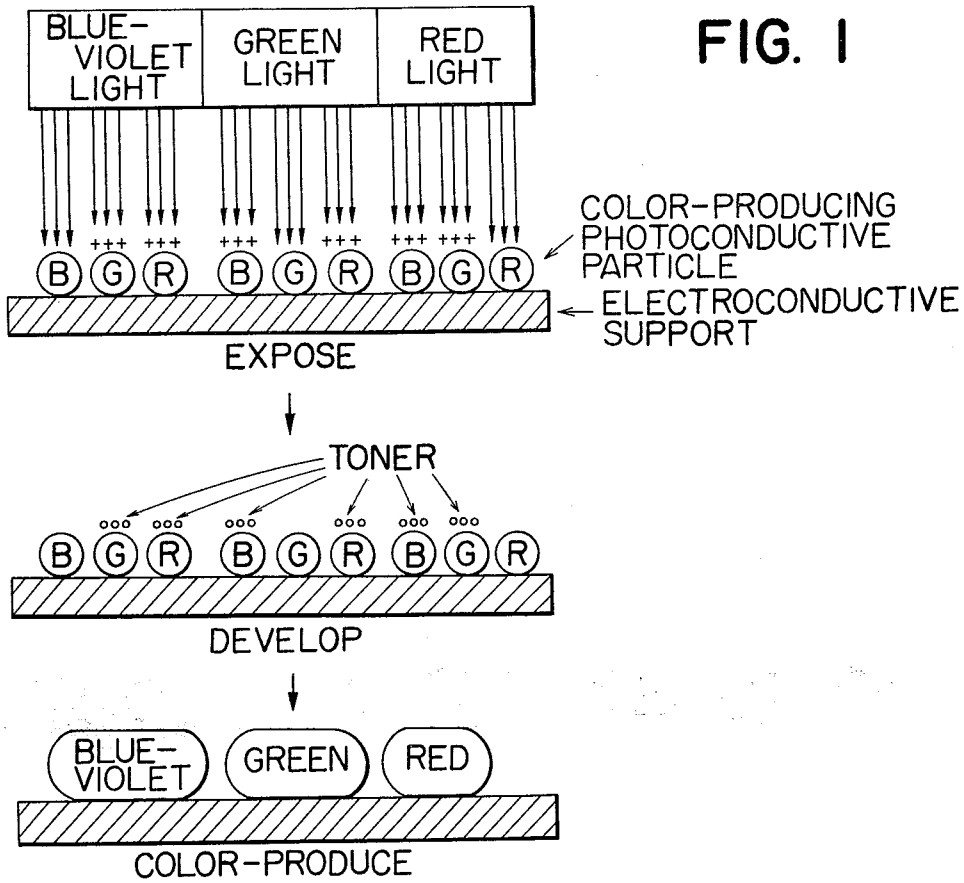
Figure 2:
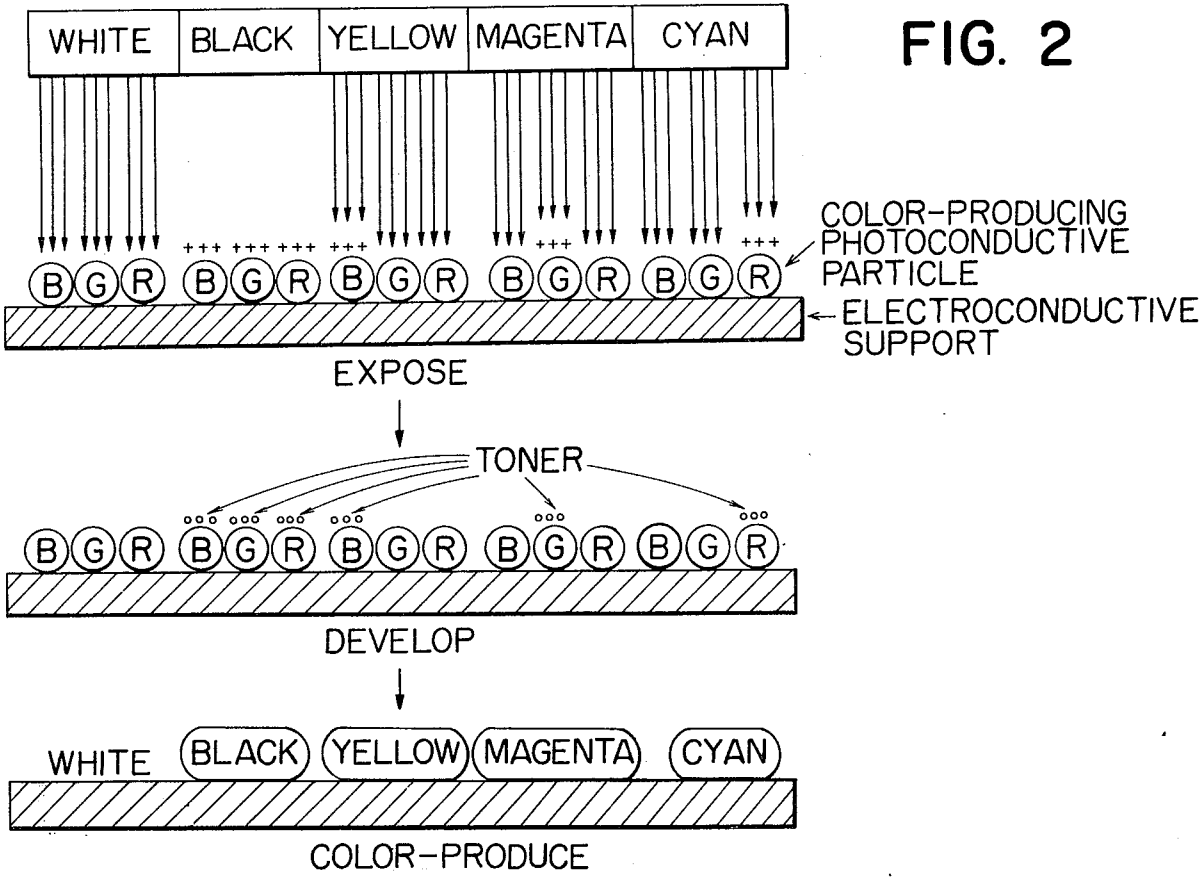

The following examples are given by way of illustration only and are not intended as limitation of this invention.

EXAMPLE 1

A suspension was prepared by mixing 600 g of zinc oxide (sold by Sakai Kagakukogyo K.K. under the trademark of Sazex 4000) with 600 g of a 30% solution of styrene-butadiene copolymer in toluene in a ball mill. The suspension was divided into three parts. Dispersions B, G and R were prepared by mixing a sensitizer and a leuco dye with the suspension as follows:

| | |
|---|---|
| Dispersion B: | |
| Auramine (blue sensitizer) | 0.02 g |
| Leuco dye (sold by Yamamoto Kagakugesei) K.K. under the trademark Na-Ye) producing yellow color | 20 g |
| Suspension prepared above | 400 g |
| Dispersion G: | |
| Rose Bengale (green sensitizer) | 0.005 g |
| Leuco dye (sold by Shinnisso Kako K.K. under the trademark PSD-P producing magenta color | 8 g |
| Suspension prepared above | 400 g |
| Dispersion R: | |
| Diacid Cyanine Green GWA (red sensitizer) | 0.04 g |
| Leuco dye (Benzoylleucomethylene Blue) producing cyan color | 15 g |
| Suspension prepared above | 400 g |

Color-producing photoconductive particles B, G and R having a particle size of 30 to 60 microns were obtained by spraying Dispersion B, G and R under a pressure of 2 kg/cm² of nitrogen gas by means of a spray gun in an atmosphere of a temperature of 25° C, respectively. Particles B, G and R having particle sizes of 37 to 44 microns were collected by sifting.

Three sheets of electroconductive support were prepared by applying a 8% solution of butyl rubber in isooctane on aluminium plates of 1 mm in thickness by means of a wire bar (No.3) to form an adhesive layer of 5 to 6 microns in thickness on the aluminium plates.

A mixture of Particles B, G and R having particle sizes of 37 to 44 microns was distributed on each of the supports prepared above to obtain Electrophotographic light-sensitive materials A, B and C of the present invention as follows: Material A was obtained by drying the support having the mixture of Particles B, G and R distributed. Material B was obtained by passing the support (dried as shown above) through a calender at a temperature of 20° C and a pressure of 15 kg/cm. Material C was obtained by passing the support (dried as shown above) through a calender at a temperature of 70° C and a pressure of 15 kg/cm.

Toner was prepared by melting a mixture of the following ingredients, cooling it to solidify and then pulverizing it to a particle size of 0.1 to 2 microns:

| | |
|---|---|
| Bisphenol A | 50 g |
| Phenolic resin (sold by Arakawa Rinsan Kagakukogyo K.K. under the trademark of Tamanol PA) | 35 g |
| Nylon 12 (sold by Toyo Rayon K.K.) | 15 g |
| Developer was prepared by mixing the toner with powdered iron as follows: | |
| Toner prepared above | 1 g |
| Powdered iron (sold by Nihon Teppan K.K. under the trademark EFV 200-300) | 30 g |

After each of Electrophotographic light-sensitive materials A, B and C was negatively charged using a conventional corona discharge of −6 kV and it was then exposed to color light whilst in contact with an color image original, and it was developed with the developer prepared above using magnetic brush method and the toner was fixed to the support by heating at a temperature of 120° to 140° C. In this way, positive-to-positive color prints were obtained. The clear prints were obtained from Materials A, B and C. However, the best one was obtained from Material C.

Electrostatic properties of Materials A, B and C and values of the color print are shown in Table 1 below:

Table 1

| | Electrostatic properties | | Values of color print | | |
|---|---|---|---|---|---|
| | Vo (volt) | $E_{10}$ (lux.sec) | Tone gradation | Resolution (lines/mm) | Density of color image |
| A | 260 | 300 | 6 | 12 | 0.8 |
| B | 350 | 250 | 8 | 15 | 1.2 |
| C | 400 | 150 | 10 | 18 | 1.5 |

Vo : acceptance potential $E_{10}$: exposure (lux.sec) required to reduce the surface electric potential to one tenth of Vo In the above-mentioned procedure of fixing the toner to the support, the same results were obtained by spraying methanol to the support instead of heating it.

EXAMPLE 2

An electrophotographic light-sensitive material of this invention was prepared by repeating the same procedure as that of Example 1 except that titanium oxide having a rutile-type structure (sold by Osaka Titanium Manufacturing K.K.) was used instead of zinc oxide.

Color prints similar to those of Example 1 were obtained by repeating the same procedure as that of Example 1.

Better color prints can be obtained by using the electrophotographic light-sensitive material passed through a calender as shown in Example 1.

EXAMPLE 3

A suspension was prepared by mixing 400 g of zinc oxide (used in Example 1) with 400 g of a 15% solution of acrylic resin (sold by Japan Reichhold Chemicals Inc. under the trademark of A-452) in toluene in an attrition mill. The suspension was divided into two parts. Dispersion $G_1$ and $R_1$ were prepared by mixing a sensitizer and a leuco dye with the suspension as follows:

| | |
|---|---|
| Rose Bengale (green sensitizer) | 0.02 g |
| Leuco dye (Rhodamine lactam sold by Shinnisso Kako K.K.) producing magenta color | 6 g |
| Suspension prepared above | 400 g |
| Dispersion $R_1$: | |
| Diacid Cyanine Green GWA (red sensitizer) | 0.04 g |
| Leuco dye (Crystal Violet Lactone sold by Shinnisso Kako K.K. producing cyan color | 7 g |
| Suspension prepared above | 400 g |

Dispersion $G_1$ and $R_1$ were dried up under a reduced pressure to obtain residues, respectively. The residues were crushed in a motor, and a mixture of the crushed residue was pulverized by means of a jet mill to obtain a mixture of Color-producing photoconductive particles $G_1$ and $R_1$ having a particle size of 15 to 30 microns.

An electroconductive support was prepared by repeating the same procedure as that of Example 1 except that aluminium-evaporated polyester film was used instead of aluminium plate.

A mixture of Particles $G_1$ and $R_1$ was distributed on the support, and the support was passed through a calender at a temperature of 70° C and a pressure of 20 kg/cm to obtain an electrophotographic light-sensitive material of this invention.

The resulting light-sensitive material was developed by repeating the same procedure as that of Example 1.

Blue, red and violet color images were formed in the regions irradiated by green, red and blue light, respectively. Violet color image was formed in the non-irradiated region.

In the procedure of fixing the toner to the support, the same results were obtained by spraying acetone to the support instead of methanol as used in Example 1.

EXAMPLE 4

A mixture of Color-producing photoconductive particles B, G and R prepared in Example 1 was distributed and attracted on a surface of polyester sheet having a thickness of 0.2 mm, which has been charged electrostatically by corona discharge of +6 kV. This sheet was placed in contact with an aluminium surface of aluminium-evaporated paper and passed through a calender at a temperature of 70° C and a pressure of 15 kg/cm. In this way, an electrophotographic light-sensitive material having a photoconductive layer on the aluminium-evaporated surface was obtained.

Toner was prepared from a mixture of the following ingredients by repeating the same procedure as that of Example 1, and then developer was prepared by mixing the toner with powdered iron as shown in Example 1.

| | |
|---|---|
| 2,2'-dihydroxydiphenyl | 10 g |
| Phenolic resin (sold by Arakawa Rinsan Kagakukogyo K.K. under the trademark of Tamanol PA) | 70 g |
| Amino resin (dimethylaminostyrene-styrene 1:1 copolymer) | 20 g |

The electrophotographic light-sensitive material prepared above was charged, exposed and developed by repeating the same procedure as that of Example 1 except that the developer prepared above was used instead of the developer in Example 1.

In this way, a positive-to-positive color print similar to those obtained in Example 1 was obtained.

Electrostatic properties of the light-sensitive material and values of the color print are shown below: Vo: 400 v; $E_{10}$: 50 lux.sec; Tone gradation: 10; Resolution: 16 lines/mm; Density of color image: 1.5.

In the color-producing procedure, the same result can be obtained by spraying ethanol instead of heating at a temperature of 120° to 140° C.

EXAMPLE 5

An electrophotographic light-sensitive material of this invention was prepared by repeating the same procedure as that of Example 4 except that titanium oxide having a rutile-type structure (sold by Osaka Titanium Manufacturing K.K.) was used instead of zinc oxide.

Color prints similar to those of Example 4 were obtained by repeating the same procedure as that of Example 4.

EXAMPLE 6

A suspension was prepared by mixing 600 g of zinc oxide (Sazex 4000 as used in Example 1) with 600 g of a 15% solution of acrylic resin (sold by Japan Reichhold Inc. under the trademark of A-457) in an attrition mill. The suspension was divided into three parts. Dispersions $B_2$, $G_2$ and $R_2$ were prepared by mixing a sensitizer and a leuco dye with the suspension as follows:

| | |
|---|---|
| Uranine (blue sensitizer) | 0.06 g |
| Leuco dye (Ne-Ye as used in Example 1) | 10 g |
| Suspension prepared above | 400 g |
| Dispersion $G_2$: | |
| Rose Bengale (green sensitizer) | 0.02 g |
| Leuco dye (Rhodamine Lactam as used in Example 3) | 7 g |
| Suspension prepared above | 400 g |
| Dispersion $R_2$: | |
| Diacid Cyanine Green GWA (red sensitizer) | 0.04 g |
| Leuco dye (Crystal Violet Lactone as used in Example 3) | 7 g |
| Suspension prepared above | 400 g |

A mixture of Color-producing photoconductive particles $B_2$, $G_2$ and $R_2$ having a particle size of 20 to 40 microns was prepared by repeating the same procedure as that of Example 1.

A mixture of Particles $B_2$, $G_2$ and $R_2$ prepared above was distributed and attracted on a surface of polyvinyl fluoride sheet having a thickness of 60 microns, which has been charged electrostatically by corona discharge of +6 kV. This sheet was placed in contact with an aluminium surface of an aluminium-evaporated polyester film having a thickness of 120 microns and passed through a calender at a temperature of 60° C and a pressure of 15 kg/cm. In this way, an electrophotographic light-sensitive material having a photoconductive layer on the aluminium-evaporated surface was obtained.

The electrophotographic light-sensitive material prepared above was charged, exposed and developed by repeating the same procedure as that of Example 1, using the developer as prepared in Example 4.

In this way, a positive-to-positive color print similar to those obtained in Example 4. This light-sensitive material gave a resolution of 16 lines/mm.

We claim:

1. An electrophotographic process for color reproduction comprising the steps of:

a. charging an electrophotographic light-sensitive material by corona discharge, said material having at least two kinds of color-producing photoconductive particles disposed at random on an electroconductive support, said particles consisting essentially of a photoconductive particle, a sensitizer and a leuco dye,
b. exposing said charged material to light,
c. developing said material by a toner containing acid substance, and
d. producing color in the leuco dye by the interaction of the leuco dye with the acid substance by heating or by dissolving the leuco dye or the acid substance with a solvent.

2. An electrophotographic process according to claim 1 wherein the interaction of the leuco dye with the acid substance is accomplished by heating.

3. An electrophotographic process according to claim 1 wherein the interaction of the leuco dye with the acid substance is accomplished by dissolving the leuco dye or the acid substance with a solvent.

4. An electrophotographic process for color reproduction comprising the steps of:
a. charging an electrophotographic light-sensitive material by corona discharge, said material having three kinds of color-producing photoconductive particles disposed at random on an electroconductive support, said color-producing photoconductive particles consisting of (i) a color-producing photoconductive particle comprising a photoconductive particle, a sensitizer absorbing blue-violet light and a leuco dye producing yellow color, (ii) a color-producing photoconductive particle comprising a photoconductive particle, a sensitizer absorbing green light and a leuco dye producing magenta color and (iii) a color-producing photoconductive particle comprising a photoconductive particle, a sensitizer absorbing red light and a leuco dye producing cyan color,
b. exposing said charged material to light,
c. developing said material by toner containing acid substance, and
d. producing color in the leuco dye by the interaction of the leuco dye with the acid substance by heating or by dissolving the leuco dye or the acid substance with a solvent.

5. An electrophotographic process according to claim 1 wherein said leuco dye is at least one selected from the group consisting of lactone ring-containing compounds, lactam ring-containing compounds, polyarylcarbinols, spirophthalans, phthalans and diphenylmethane dyes.

6. An electrophotographic process according to claim 1 wherein said toner contains at least one acid substance selected from the group consisting of phenolic substance, an organic acid and an inorganic acid substance.

7. An electrophotographic process according to claim 6 wherein said toner contains an amino resin.

8. An electrophotographic process according to claim 1 wherein said color-producing photoconductive particle contains a thermoplastic binder which binds the photoconductive particles to one another.

9. An electrophotographic light-sensitive material comprising an electroconductive support and a photoconductive layer consisting of at least two kinds of color-producing photoconductive particles disposed at random on the support, said color-producing photoconductive particles consisting essentially of a photoconductive particle, a sensitizer and a leuco dye.

10. An electrophotographic light-sensitive material comprising an electroconductive support and a photoconductive layer having three kinds of color-producing photoconductive particles disposed at random on the support, said color-producing photoconductive particles consisting of (i) a color-producing photoconductive particle comprising a photoconductive particle, a sensitizer absorbing blue-violet light and a leuco dye producing yellow color, (ii) a color-producing photoconductive particle comprising a photoconductive particle, a sensitizer absorbing green light and a leuco dye producing magenta color and (iii) a color-producing photoconductive particle comprising a photoconductive particle, a sensitizer absorbing red light and a leuco dye producing cyan color.

11. A method of making an electrophotographic light-sensitive material comprising the steps of:
a. distributing at least two kinds of color-producing photoconductive particles at random on an adhesive electroconductive support, said color-producing photoconductive particles to consisting essentially of a photoconductive particle, a sensitizer, a leuco dye and a binder, and
b. adhering the color-producing photoconductive particles one another and then to the support by pressing.

12. A method according to claim 11 wherein said pressing is carried out under condition of heating.

13. A method of making an electrophotographic light-sensitive material comprising the steps of:
a. depositing electrostatically at least two kinds of color-producing photoconductive particles on a surface of charged dielectrics, said particles consisting essentially of a photoconductive particle, a sensitizer, a leuco dye and a binder, and
b. transferring said color-producing photoconductive particles onto a surface of an electroconductive support by pressing the support in contact with a layer of the color-producing photoconductive particle.

14. A method according to claim 13 wherein said transfer is carried out by pressing accompanied by heating.

* * * * *

UNITED STATES PATENT OFFICE
CERTIFICATE OF CORRECTION

Patent No. 4,007,045 Dated February 8, 1977

Inventor(s) Eisuke Ishida, et al

It is certified that error appears in the above-identified patent and that said Letters Patent are hereby corrected as shown below:

Column 5, Example 1, third line of Table: Change "Kagakugesei)" to --Kagakugosei--.

Column 7, line 1 of first Table: Insert --Dispersion $G_1$:-- as a separate line above "Rose Bengale (green sensitizer)".

Column 8, line 1 of Table: Insert --Dispersion $B_2$:-- as a separate line above "Uranine (blue sensitizer)".

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*